US012128323B2

(12) United States Patent
Simone

(10) Patent No.: US 12,128,323 B2
(45) Date of Patent: Oct. 29, 2024

(54) FLIPPER SYSTEM FOR ARCADE GAMES

(71) Applicant: John A. Simone, Vista, CA (US)

(72) Inventor: John A. Simone, Vista, CA (US)

( * ) Notice: Subject to any disclaimer, the term of this patent is extended or adjusted under 35 U.S.C. 154(b) by 0 days.

(21) Appl. No.: 18/244,866

(22) Filed: Sep. 11, 2023

(65) Prior Publication Data

US 2024/0108972 A1 Apr. 4, 2024

Related U.S. Application Data

(60) Provisional application No. 63/405,132, filed on Sep. 9, 2022.

(51) Int. Cl.
*A63F 7/24* (2006.01)

(52) U.S. Cl.
CPC ..... *A63F 7/2409* (2013.01)

(58) Field of Classification Search
CPC ..... A63F 7/24; A63F 7/2409; A63F 7/2418; A63F 7/2472; A63F 7/2481
USPC ..... 273/129 W, 129 V, 129 R
See application file for complete search history.

(56) References Cited

U.S. PATENT DOCUMENTS 3,298,691 A * 1/1967 Berninger ..... A63F 7/26 273/129 R
3,391,937 A * 7/1968 Seiden ..... A63F 7/26 273/129 R
3,404,888 A * 10/1968 Reedy, Jr. ..... A63F 7/3075 273/121 A
4,109,916 A * 8/1978 Breslow ..... A63F 7/027 273/121 D
4,199,143 A * 4/1980 Dieckhaus ..... A63F 7/2409 273/121 A
4,398,718 A * 8/1983 Wiczer ..... A63F 7/26 273/129 V
4,533,142 A * 8/1985 Peters ..... A63F 7/2409 124/79
4,828,263 A * 5/1989 Nordman ..... A63F 7/26 273/129 R
4,971,323 A * 11/1990 Gottlieb ..... A63F 7/027 273/121 A
5,131,654 A * 7/1992 Gottlieb ..... A63F 7/26 273/121 A
5,284,342 A * 2/1994 Tanzer ..... A63F 7/027 273/127 R
5,297,793 A * 3/1994 DeMar ..... A63F 7/027 273/121 A
5,961,116 A * 10/1999 Beyer ..... A63F 7/027 273/129 R

* cited by examiner

*Primary Examiner* — Joseph B Baldori
(74) *Attorney, Agent, or Firm* — Donn K. Harms

(57) ABSTRACT

A flipper system for retrofitting existing flippers of a pinball game which rotate in operative engagement with a solenoid, with new flippers. The new flippers have an opening which is removably engageable upon an engagement end of a rotatable actuator shaft and can include hollow cavities within a metal body of the new flipper. An improved connection to the existing solenoid is provided by inclusion of a actuator shaft and clamp with the system.

14 Claims, 9 Drawing Sheets

FLIPPER SYSTEM FOR ARCADE GAMES

This application claims priority to U.S. Provisional Patent Application Ser. No. 63/405,132, filed on Sep. 9, 2022, which is incorporated herein in its entirety by this reference thereto.

BACKGROUND OF THE INVENTION

1. Field of the Invention

The invention herein disclosed relates generally to arcade type games, such as pinball. More particularly, it relates to a flipper system for pinball machines providing differently configured metal flippers for operative engagement to flipper actuator shafts.

2. Prior Art

In the realm of arcade type games, pinball is a highly popular game used in arcades and, more modernly, in homes. In a pinball machine, a ball rolls and is propelled inside a specially designed cabinet known as the pinball machine. During the travel of each such ball, hitting various lights, bumpers, ramps, and other targets both awards the user points and elongates the duration of the ball during a turn.

Conventionally, the object in playing pinball is generally to score as many points as possible by hitting multiple targets and making various shots with user actuated flippers before the ball is lost. Duration of play varies conventionally, in such machines, from one ball per turn to multiple balls sequentially shot during a turn.

Conventionally, once a ball is placed into play by a player, they will have the option to employ one or a plurality of flippers to strike the pinball and maintain it in play. These flippers, in order to impart the significant force required to propel the metal pinball, are actuated by a solenoid which imparts translation to a plunger rotationally connected to a clamp which is engaged to a shaft having a flipper thereon. The user, during a game, employs buttons or switches to energize the solenoid and thereby actuate the flipper to rotate in attempts to strike the pinball.

Such a flipper contact with the pinball in skilled hands will cause the pinball to be propelled from the face of the flipper. This will generally result in an increase in targets hit and a resulting increase in points earned during the turn of the player. A pinball game ends when all of the pinballs, made available to the player, exit the play area of the pinball machine. Flippers in the hands of a skilled user can significantly increase this duration and the point score by striking pinballs headed toward an exit from play and thereby maintaining the pinballs in play.

In recent years such arcade games have evolved to a digital format employing software and a video display screen for use by the user during a turn. However, a resurgence in the popularity of mechanical pinball machines has occurred, wherein players enjoy the physical and tactile aspects of such machines, as well as no noise and lights and the like connected with conventional pinball machines.

With respect to the above, before explaining at least one preferred embodiment of the flipper system herein it is to be understood that the invention is not limited in its application to the details of employment and to the arrangement of the components or the steps set forth in the following description or illustrated in the drawings. The various components and construction of the disclosed flipper apparatus and methods and steps of employment thereof, are capable of other embodiments and of being practiced and carried out in various ways. All of which will be obvious to those skilled in the art once the information herein is reviewed and thus are considered within the scope of this invention and which are considered within the scope of this application.

Also, it is to be understood that the phraseology and terminology employed herein are for the purpose of description and should not be regarded as limiting. As such, those skilled in the art will appreciate that the conception upon which this disclosure is based may readily be utilized as a basis for other arcade game flipper systems. It is important, therefore, that the embodiments, objects, and claims herein, be regarded as including such equivalent construction, operation and methodology, insofar as they do not depart from the spirit and scope of the present invention.

SUMMARY OF THE INVENTION

The disclosed arcade game flipper system herein provides a significant advance in the utility and operation of pinball machines through the provision of a metal body flipper system. The flippers can be made available singularly or from a kit or group of preferably metal flippers where each may have a variable length and/or varied mass for the flipper body.

The metal body may be configured to operatively engage existing flipper actuator shafts on conventional pinball machines, however, conventionally, such flippers are permanently engaged to the rotating shafts. More preferably, the flipper herein is configured for removable engagement to a provided actuator shaft. The actuator shaft is engageable with the clamp used in conventional pinball machines, or in another preferred mode of the device and system herein, the flipper is removably engageable to a provided metal actuator shaft which is engageable with the clamp employed on conventional flipper actuator solenoids or motors of existing or newly manufactured pinball machines.

The flipper system in all modes herein provides a flipper body which is configured with a connector at a first end thereof for operative engagement to the a solenoid-actuated rotating flipper shaft which are employed on conventional pinball machines, if such existing shafts allow. More preferably, the flipper system herein provides a replacement metal actuator shaft which is configured on a first end for operative engagement to the clamp of conventional pinball machines. By operative engagement is meant herein that the connector is formed at the first end of the body of the flipper and will mate with and removably engage with the projecting end of a rotating actuator shaft of a flipper actuator of a pinball machine.

Particularly preferred for such operative engagement is a splined recess formed in the body of the flipper at a first end thereof, which cooperatively mates with a splined actuator shaft connected to the flipper actuator motor. This is particularly preferred as it allows the user to adjust the angle of the flipper projecting from the actuator shaft by placing the splines in the recess of the flipper into different mating recesses on the projecting end of the actuator shaft. Other examples, which should not be considered limiting, are a tapered recess formed at the first end of the body of the flipper which cooperatively contacts a taper or tapered spline on the flipper actuator shaft and is compressed into a fixed position by a fasteners, such as a screw. Of course, other connectors may be employed as would occur to those skilled in the art and all are considered within the scope of this patent.

With the flipper body, herein disclosed, operatively engaged with the actuator shaft which is connected to a solenoid or motor in a pinball machine, the flipper body will rotate when that electric solenoid or a flipper motor is activated to rotate by the player. Conventionally, such activation of flippers employs a flipper button switch or actuator positioned on the pinball machine within reach of the hand or hands of the player. Upon activation of the flipper actuator button by the player, the rotation of the flipper solenoid or motor will rotate the actuator shaft and cause the engaged flipper to move in a circular fashion around the axis of the shaft which the motor rotates.

It is the timing and speed of the rotation of the flipper which will determine if and how well the player contacts the intended pinball. The flipper system herein provides the player a significant improvement in both the rotational speed and the force of contact of the actuated flipper, against the intended pinball.

A first improvement in contact against an intended pinball is provided by the formation of the body of the flipper herein substantially of metal. The current preferred metal is 6061-T6 aluminum or similar metals. However, steel or other heavier metals may be employed where more mass is desired. Additionally, while metal is preferred other modes of providing the mass and stiffness of metal can be employed, such as a resin or polymeric material containing metal flakes, or a composite material such as carbon and resin. The rigidity and solid contact of a metal bodied flipper increases the force of the flipper body in rotation communicated to the pinball.

Also, in all the most preferred modes of the flipper system herein, the metallic body of the flipper may have an internal cavity formed therein which is anywhere from ten to eighty percent of the volume of the metal body forming the flipper. The reduction in internal mass of the body of the flipper herein provides a means to increase the acceleration of the flipper when the flipper solenoid motor is actuated. A flipper body of less mass, having a larger internal cavity, will accelerate in rotation faster than a flipper body having a smaller internal cavity and more total mass.

There can be a trade off in choosing the body with the appropriate internal cavity volume, since too little mass even when accelerated more quickly may not provide the force and impact to the pinball desired. However, experienced players will discern which flipper body, mounted on which of the multiple flipper motor shafts of a particular pinball machine, will provide them the best performance. Such may also take into consideration the skill and play style of the player. With a kit of flippers having flipper bodies varying in mass due to larger or smaller internal cavities, each player will be able to customize the machine they are playing upon with the flipper best suited to the machine, the position within the machine, and the players skill and style of play.

An additional characteristic of the flipper body of the flipper system herein, in combination with the variable mass noted above, is the provision of the flipper bodies which vary in total length in the kit or group thereof. A shorter flipper body will increase the rotation speed of the flipper. However, players who tend to hit the pinball at the second end of the flipper may prefer a flipper body having a longer length to give them more area to contact a pinball. Currently, a preferred range of the length of the flipper body is between 1.5 inches and 4 inches. Thus, the kit or group of flippers in the plurality of flipper bodies available to players can include multiple flipper bodies, each having a different length with the range noted. A current preferred length of each, in a group of flipper bodies, includes lengths of 3 3/16", 2 15/16", 2 3/4", 2 5/8", 2 1/4 ", and 1 7/8". Of course, other lengths can be added to this group.

It is envisioned that the flipper bodies may be marked or otherwise provided with visually discernable indicia, colors, or the like, which will provide the player a means to discern the mass and the length of each flipper body. Thus, a user desiring a shorter flipper with more mass can discern which of the group or kit available will provide them with those desired physical characteristics. Such will also enable pinball tournaments and the like to "handicap" players by allowing those of lesser skill to pick the flipper which will work best for them to even the gap.

For pinball machines lacking the appropriate solenoid-engaged shaft to engage the flipper body herein, the system herein can include metal flipper actuator shafts which can be engaged to existing flipper motors on existing pinball machines. Conventionally, pinball machines use a clamp which is rotated by a solenoid to maximize speed and force communicated to the actuator shaft. The motor actuator shafts included with the flipper body will be configured for easy operational engagement to existing flipper actuators on an engagement end. Currently, forming the engagement end in a diameter configured for compressed engagement with the clamp of the existing machine which is operatively connected to the solenoid. On the opposite or distal end of the flipper shaft will be the appropriate mating connector to engage with a mating connector located on the first end of the flipper body provided herein.

It should also be noted that the flipper bodies of the system herein have a ledge around the lower exterior circumference which is configured for engagement of a rubber or polymeric bumper thereon. It is this bumper that provides padding between the metal pinball and the body during contact therebetween. This ledge is removably engageable with a polymeric or rubber bumper configured to engage upon the ledge. The system herein can provide rubber and polymeric bumpers having differing durometer as well as differing frictional characteristics to allow the player to choose the ledge-mounted bumper most suited to their game skills or to the machine on which the flipper is engaged. For example and in no way limiting, a rubber bumper engaged on the ledge will have a softer durometer than a polyurethane bumper. The softer bumper will maintain contact with the pinball longer than the bumper of harder durometer but also will lessen the force of contact against the pinball. The bumpers, like the flipper body, can be color coded or marked with indicia to provide players the durometer and frictional characteristics to enable them to choose.

In another preferred mode of the device and system herein, in addition to the above noted flipper, an actuator shaft and clamp is provided. Because the engagement or first end of the actuator shaft, so provided, has a planar surface on one side, it securely engages with an opening in the clamp provided with it. This planar surface area is contacted by a planar side of an opening in the clamp wherein a compressed engagement may be formed by tightening a connector, such as a screw, engaged on one end of the clamp. The opposite end of the clamp is configured for operational engagement to the existing solenoid connection of the pinball machine in which it is positioned. Such clamps conventionally rotate the end of the clamp where the shaft is engaged when a solenoid connected thereto translates. This mode of the flipper system herein provides the most secure engagement of the actuator shaft to the underlying clamp and prevents twisting of the clamp upon the actuator shaft should it become sightly loose.

With respect to the disclosed arcade game flipper system herein, before explaining at least one preferred embodiment, it is to be understood that the disclosed invention is not limited in its application to the details of operation nor the arrangement of the components or the steps set forth in the following description or illustrations in the drawings. The various structural configurations and implementation of the flipper system herein are capable of other embodiments and of being practiced and carried out in various ways which will be obvious to those skilled in the art once they review this disclosure. Also, it is to be understood that the phraseology and terminology employed herein are for the purpose of description of the flipper system and should not be regarded as limiting.

As such, those skilled in the art will appreciate that the conception upon which this disclosure is based may readily be utilized as a basis for designing of other arcade game flipper systems, methods, and device configurations for carrying out the several purposes of the disclosed device and system herein. Therefore, the objects and claims herein should be regarded as including any and all such equivalent construction, components, steps, and methodology insofar as they do not depart from the spirit and scope of the present invention.

It is an object of this invention to provide an interchangeable flipper system for a pinball type arcade game wherein any of a plurality of differently configured flippers may be easily engaged and employed by players during pinball gaming.

It is another object of this invention to provide such a flipper system which allows for easy engagement and replacement of both flippers and bumpers to allow players to customize a pinball game to their skill level and or liking.

It is a still further object of this invention to provide interchangeable flippers which are visually identified as to characteristics and can be easily engaged and disengaged and replaced on pinball machines thereby allowing for a handicap system, allowing lower ranked players to use enhanced flippers when competing against more skilled adversaries.

These, together with other objects and advantages which become subsequently apparent, reside in the details of the construction and configurations of the pinball arcade game flipper system herein as more fully hereinafter described and claimed, reference being had to the accompanying drawings forming a part thereof, wherein like numerals refer to like parts throughout.

Also, further objectives of this flipper system invention will be ascertained by those skilled in the art as brought out in the following part of the specification wherein the detailed description is for the purpose of fully disclosing the invention without placing limitations thereon.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Finally, by the term "substantially" with regard to size or volume or mass, is meant plus or minus five percent, unless respectively otherwise defined, and by the term "substantially" with regard to alignment and positioning is meant plus or minus five percent.

BRIEF DESCRIPTION OF DRAWING FIGURES

The accompanying drawings, which are incorporated herein and form a part of the specification, illustrate some, but not the only or exclusive examples of embodiments and/or features of the disclosed pinball arcade game flipper system herein. It is intended that the embodiments and figures disclosed herein are to be considered illustrative of the invention herein, rather than limiting in any fashion.

DETAILED DESCRIPTION OF THE PREFERRED EMBODIMENTS OF THE INVENTION

Figure 1:
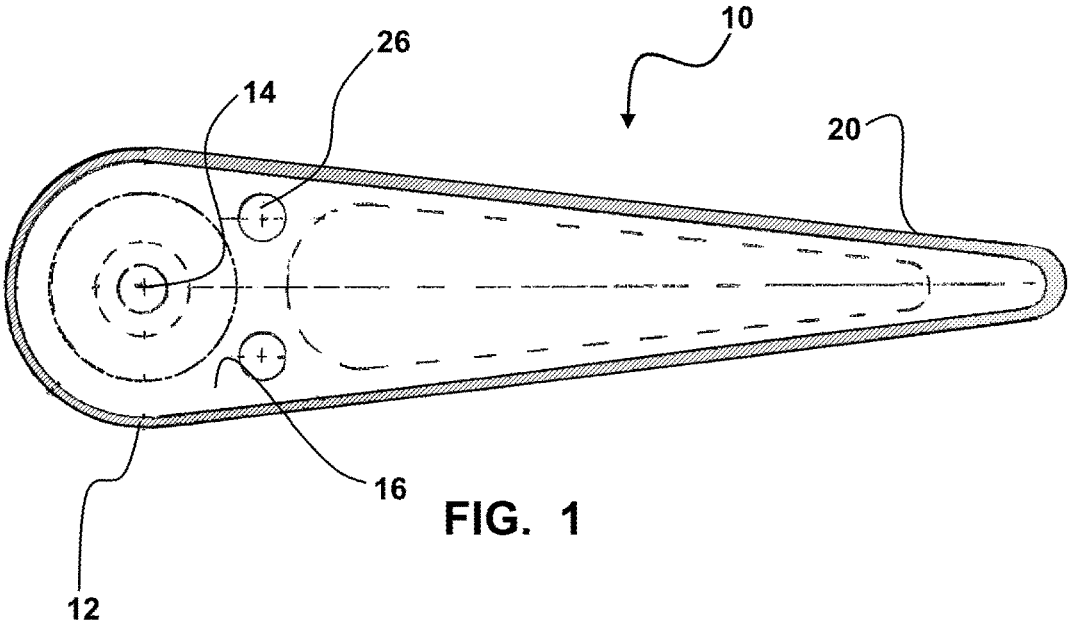
FIG. 1 shows an overhead view of a removably engageable flipper of the system herein.

Referring now to the arcade game flipper system 10 herein shown in simple format by the depictions of FIGS. 1-15, there is seen in FIG. 1 an overhead view of a removably engageable flipper 12 of the system 10 herein. As shown, the flipper 12 has a body 16 which tapers from a wider first end to a narrow distal end. The body 16 has an opening 14 communicating therethrough from the top to the bottom of the body 16. This opening 14 is configured for engagement of the flipper 16 upon an engagement end 28 of an actuator shaft 18 (FIG. 4) which, in a pinball machine, rotates when the player operates flipper switches.

A flipper 12, configured for use, will conventionally have a bumper 20 which is configured to mount around a circumferential ledge 22 (FIG. 6) which projects from the body 16 of the flipper 12.

Figure 2:
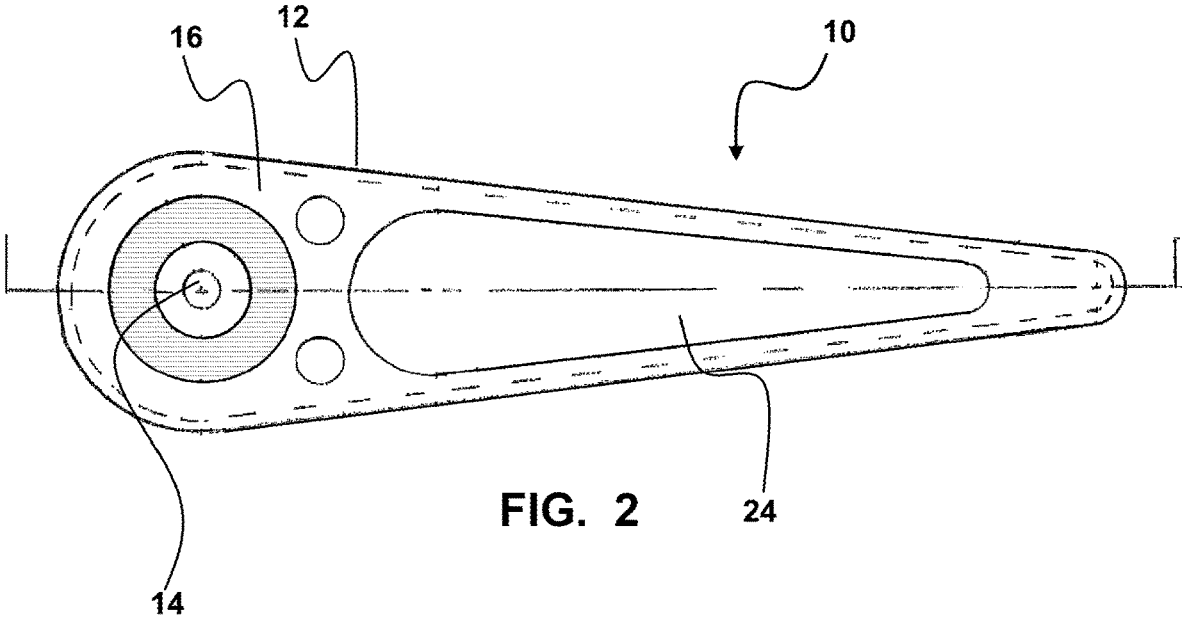
FIG. 2 shows a bottom view of the flipper of FIG. 1.

In FIG. 2 is depicted the bottom view of the flipper 12 of FIG. 1. As shown, the body 16 of the flipper 12 can include a void or cavity 24 therein which is employed to alter the total mass and therefor the contact power of the flipper 12 during contact with a ball of the pinball machine. The volume or size of such a cavity 24 can be altered or changed in the bodies of flippers 12 such that they can be rated for mass which will allow for choosing of a respective flipper 12 by users which has the desired mass. Also shown in FIGS. 1-2 are secondary openings 26 which may be employed with a mounting tool, such as a puller to remove a flipper 12 from an engagement with the actuator shaft 18 when it is tightly engaged.

Figure 3:
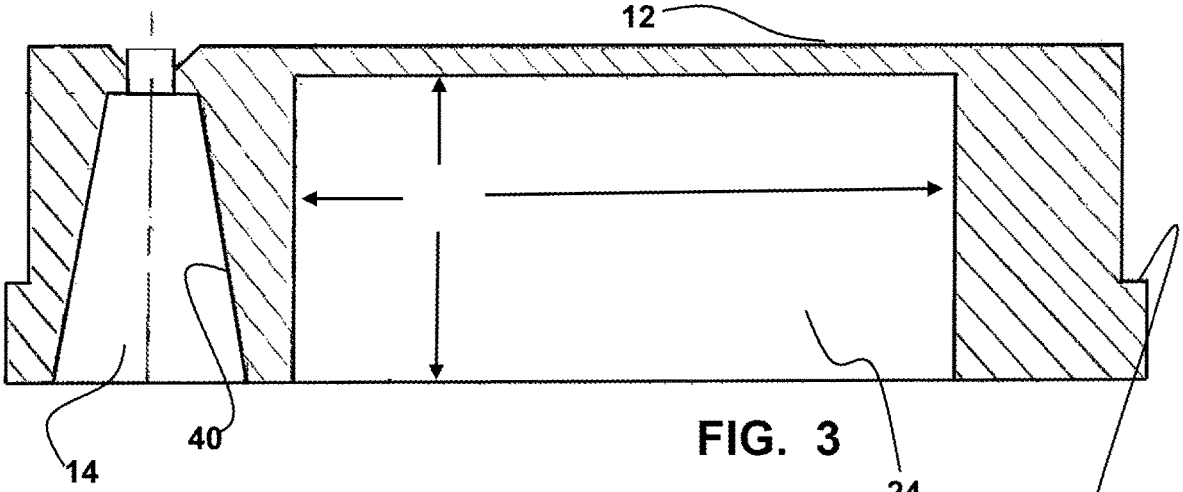
FIG. 3 depicts a sectional view through the flipper of FIG. 2 along line 3-3.

Shown in FIG. 3 is a sectional view through the body 16 of a flipper 12 of FIG. 2 along line 3-3. In the view of FIG. 3, the cavity 24 is shown, as is the opening 14, communicating through the body 16 adjacent the first end of the flipper 12. As shown, the opening 14 is tapered in size and shape in a configuration which matches a taper of the distal or engagement end 28 of the depicted flipper actuator shaft in FIG. 4 on which the body 16 of the flipper 12 engages.

Figure 7:
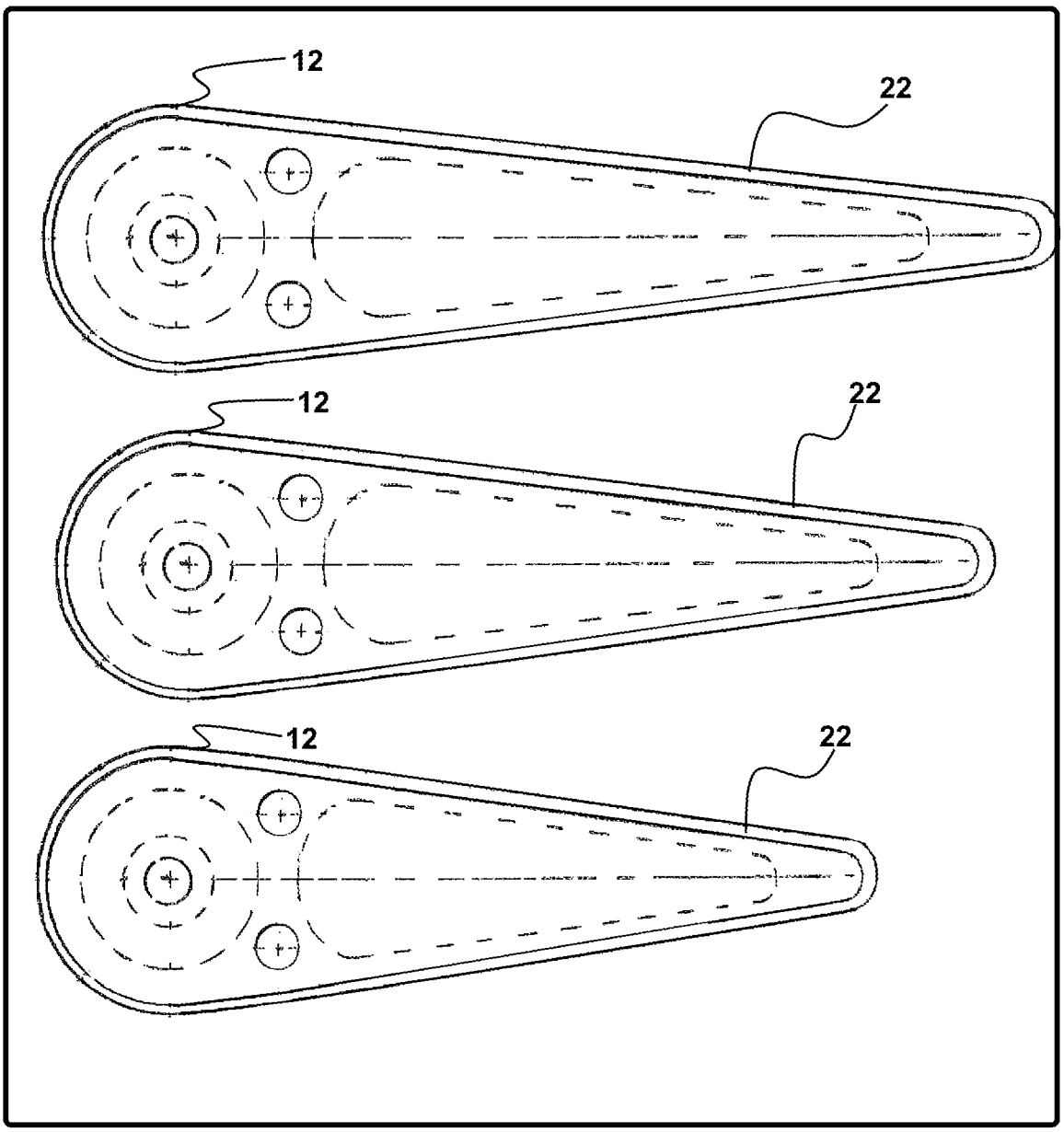
FIG. 7 shows a kit of flippers of different sizes where each is engageable to the actuator herein.
Figure 8:
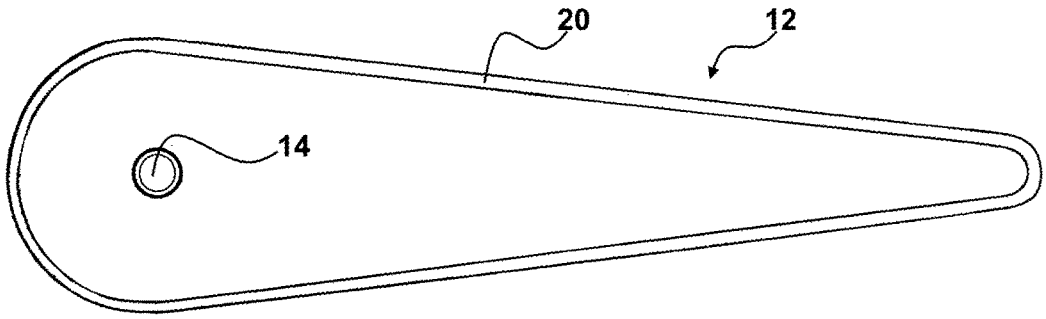
FIG. 8 depicts a flipper of the system herein having a ledge thereon for engaging a bumper.
Figure 9:
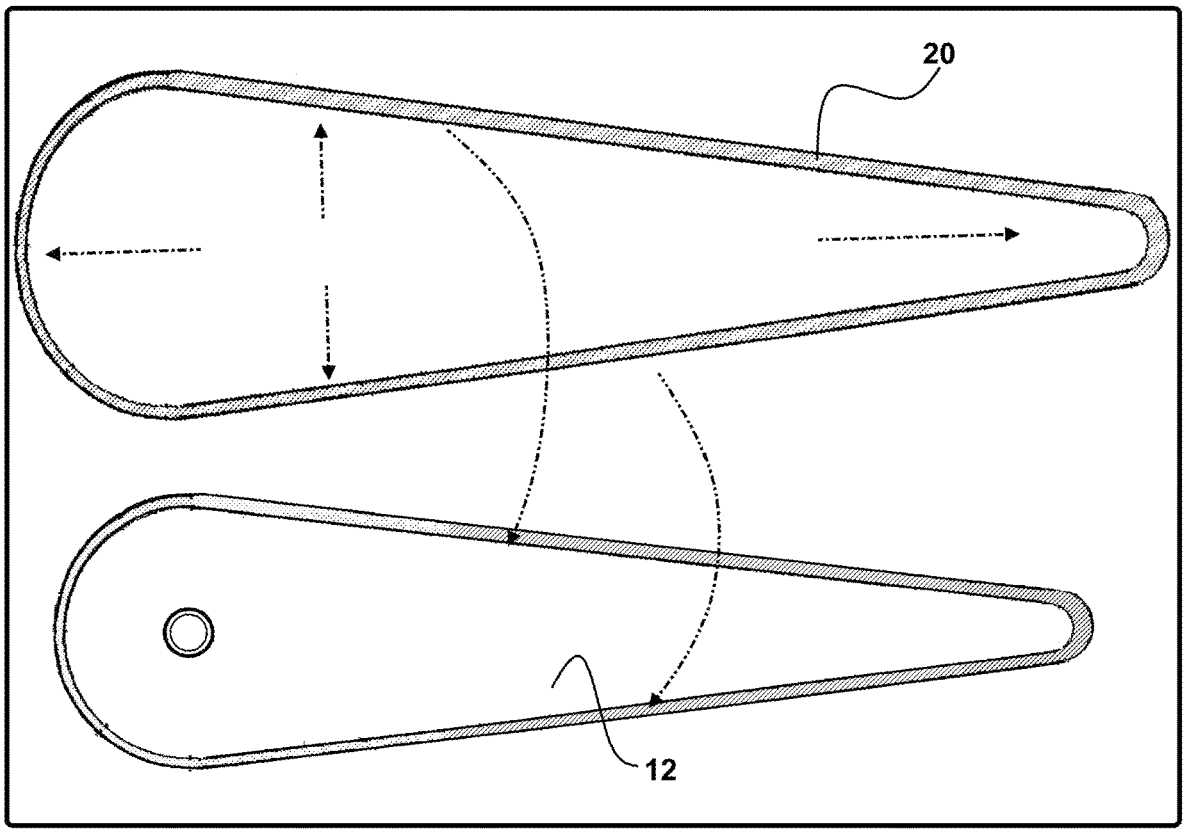
FIG. 9 depicts the elastic engagement of a bumper upon the ledge of a chosen flipper.

This tapering of both the opening 14 and the distal or engagement end 28 of a actuator shaft 18 is preferred in that it provides a strong removable mount for the flipper 12 upon the actuator shaft 18 which is easily disengaged to allow for the engagement of other similarly configured flippers 12, such as from a kit thereof, as in FIG. 7. As noted herein, the actuator shaft 18 with such a taper and or splines on the distal end or engagement end can be included in the system 10 provided to the user. In most cases conventional pinball machine flippers are permanently engaged to such an actuator shaft and cannot be removed so the combination in the system 10 of an actuator shaft 18 and flipper 12 together is preferred where the pinball machine has the original hardware therein but employs a conventional clamp similar to that of FIGS. 13 and 15 to rotatably connect the shaft 18 to a solenoid or motor.

Figure 4:
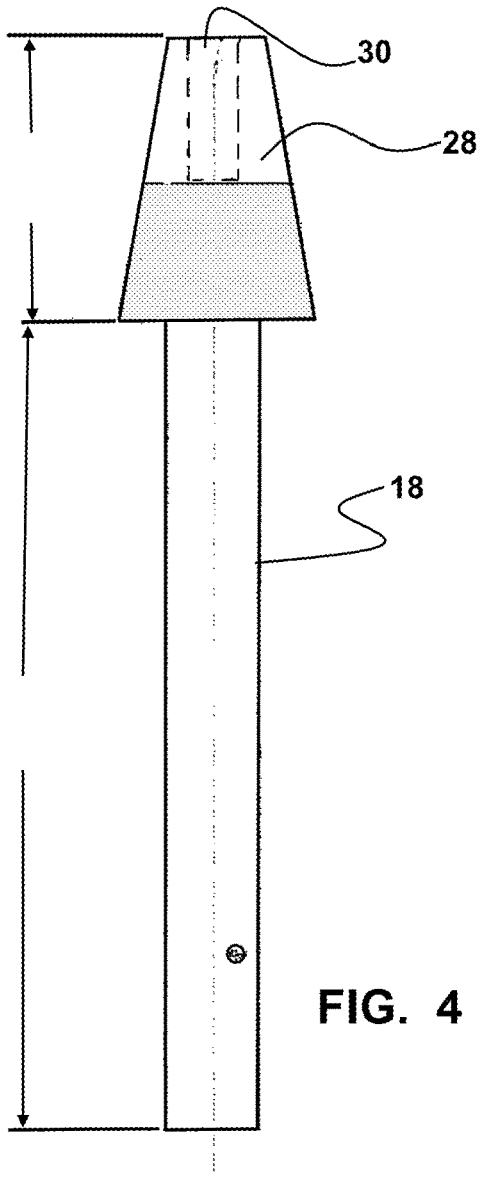
FIG. 4 shows a side view of a flipper actuator or motor shaft on which the flippers herein operatively engage and can be provided herein.

As noted, in FIG. 4 is depicted a preferred configuration for an actuator shaft 18 for employment with a pinball machine which will removably engage at the distal or engagement 28 end with any of the flippers 12 having a matching mating opening 14 therein. A mounting fastener 29, such as a screw (FIG. 14), is engaged in the mounting cavity 30 to hold the body 16 of a flipper 12 of the system 10 herein in the removable operative engagement with the engagement end 28 of an actuator shaft 18. Splines 31 (FIG. 14) or mating recesses may be included upon the engagement end 28 which are configured to match similar splined areas in the opening 14 of the flipper 12. The first end of the actuator shaft 18 is engageable to an existing solenoid 36 (FIG. 15) of a pinball machine in an operable engagement. By operable engagement of the first end of the actuator shaft 18 is meant that it will rotate when the solenoid 36 is actuated by the player using a flipper button or switch. This operative engagement can be by using a clamp 34 as shown herein which is a widely employed means for operative engagement of such actuator shafts 18.

Figure 5:
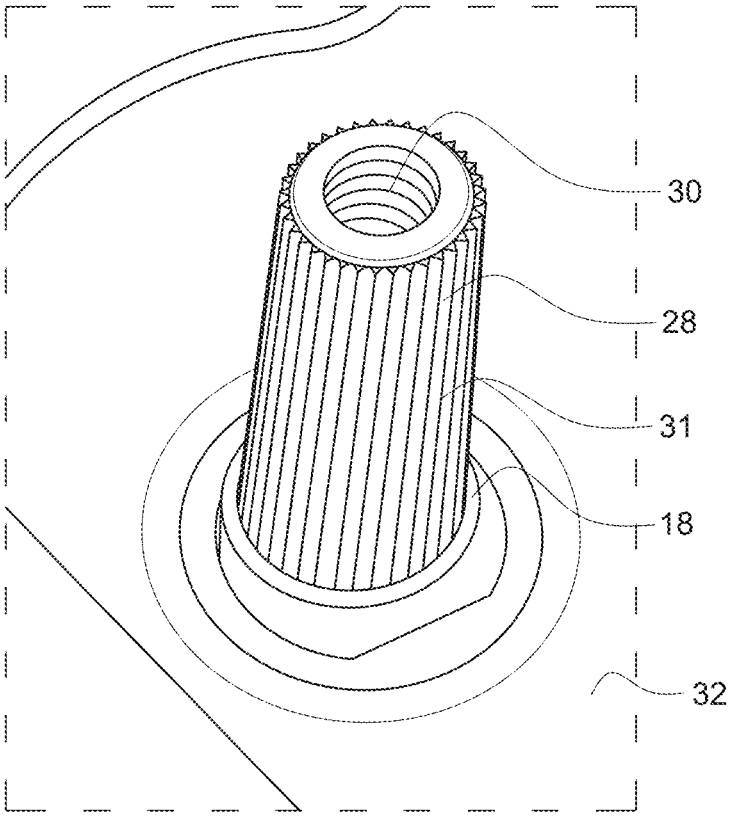
FIG. 5 shows a mode of the distal or engagement end of the flipper motor shaft on which the flippers herein removably engage.

Shown in FIG. 5 is a view of a conventional positioning of the distal end of the actuator shaft 18 of the system 10 herein as it will be positioned to rise above the playing surface of a conventional pinball machine 32. As shown the engagement end 28 projects above the playing surface of the pinball machine 32 and provides for easy removable engagement of any flipper 12 herein which would have the lower opening 14 configuration to match and removably mount to the distal or engagement end 28 of the projecting actuator shaft 18. The shown engagement end 28 has splines 31 as in FIG. 14 which, as noted, may mate with the recesses between complimentary shaped splines within the opening 14.

Figure 6:
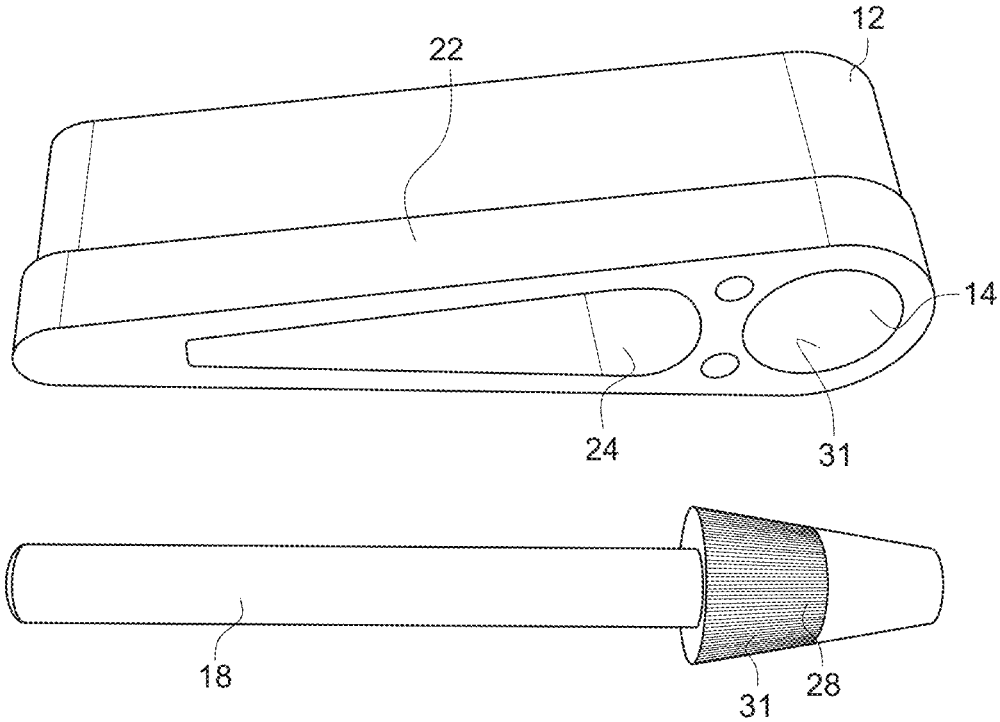
FIG. 6 shows a flipper body of the system herein adjacent a flipper motor shaft which the user may engage to an existing pinball machine.
Figure 13:
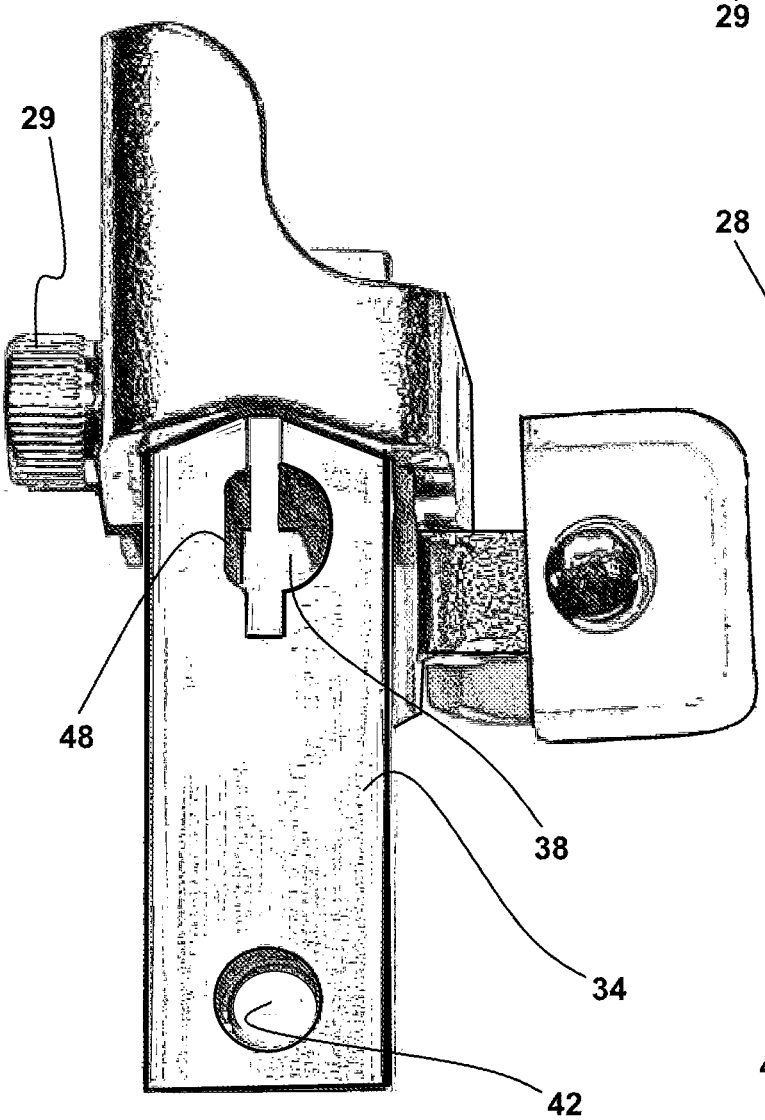
FIG. 13 depicts a clamp which may be included in the system herein along with the shaft shown in FIG. 14.
Figure 14:
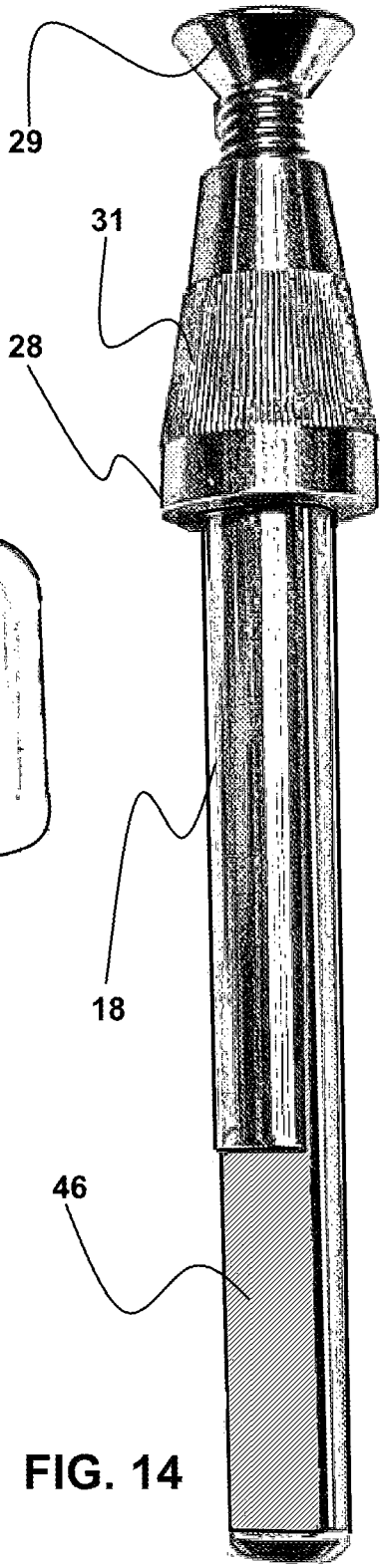
FIG. 14 shows a preferred actuator shaft configuration for an actuator shaft provided in combination with a flipper and clamp.

In configurations of the system 10 herein, used to retrofit an existing pinball machine 32, the components shown in FIG. 6 and or FIGS. 13-14, can be provided in a combination. Existing actuator shafts 18 can be replaced with the actuator shaft 18 of FIG. 6 or the like, which will be configured on the engagement end 28 to removably operatively engage with any of the flippers 12 in the system 10. The first end of the provided actuator shaft 18 will be configured to either operatively engage with a conventional clamp 34 of a pinball machine which engages with a solenoid 36, as in FIG. 6. The second end of the provided actuator shaft 18 will be configured to removably engage with any flipper 12 herein. It should be noted that the clamp 34 (FIGS. 13 and 15) of conventional pinball machines have a round shaft opening 38 therein and where the existing clamp is used the first end of the actuator shaft 18 herein would be round in a diameter sized to operatively connect to the existing clamp 34. Once the actuator shaft 18 is connected to a clamp 34 which is engaged to a user actuated solenoid 36, any flipper 12 herein may be engaged to the engagement end 28 of the actuator shaft 18 in a removable engagement allowing replacement using another flipper 12 if needed or desired.

As shown in FIG. 7, the system 10 herein can provide kits of flippers 12 wherein the players may pick or be assigned any flipper 12 from the kit thereof which is configured to engage the actuator shafts 18 of the intended pinball machine 32. While shown with three flippers 12 of differing lengths, the kit of flippers 12 can also include an unlimited number of flippers 12 having different lengths, widths, mass, or other characteristics as noted herein.

As with the differing characteristics of the flippers 12 of the system herein 12, differing polymeric bumpers 23, which are engageable to the ledges 22 positioned on the body 16 of each flipper 12 herein, can be provided. Currently, flexible or polymeric material forming the bumpers 20 has a durometer between 30-60. To that end, the bumpers 20 can be formed of rubber, polymeric and elastic materials allowing for an easy engagement to a ledge 22, as in FIG. 9. The user will simply stretch the body of the chosen or assigned bumper 20 and engage it upon the ledge 22 of the intended flipper 12, whereupon the polymeric material thereof will contract. Once so contracted, the bumper 20 will achieve a biased or compressed engagement on the ledge 22 of the flipper 12 and be ready for use.

Figure 10:
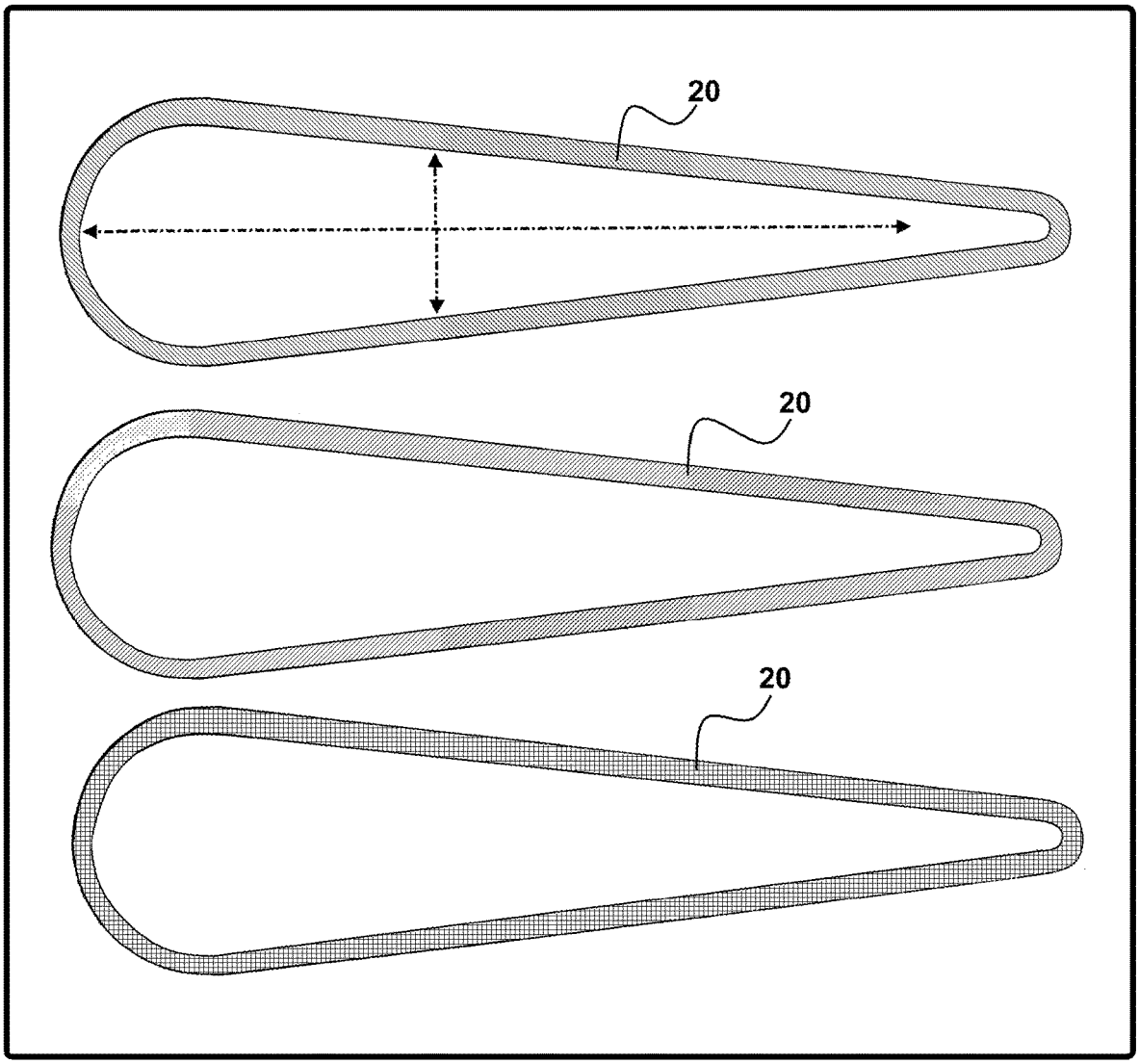
FIG. 10 shows a kit of bumpers which may have differing frictional and durometer qualities wherein each is adapted for removable engagement upon a flipper, as in FIG. 9.

As noted, the system 10 can include kits of bumpers 20, such as is shown in FIG. 10, where each member of the kit is configured to operatively engage a flipper 12 of the system 10. In the kit, the durometer and exterior surface of each bumper 20 can be altered to provide differing play characteristics. For example, a softer durometer material in the durometer range of 30-60 may impact the pinball to cause it to bounce differently than where the bumper is a harder durometer. Ridges on the exterior surface of the bumper 20 will cause a pinball impacting such to possibly spring or have a differing bounce than where the exterior surface is smooth. There are many different combinations of material durometer and surface which can be formed to such bumpers 20 which, as noted, may be provided in a kit, such as in FIG. 10, where users may choose a bumper 20 with desired play characteristics or may be assigned one.

Figure 11:
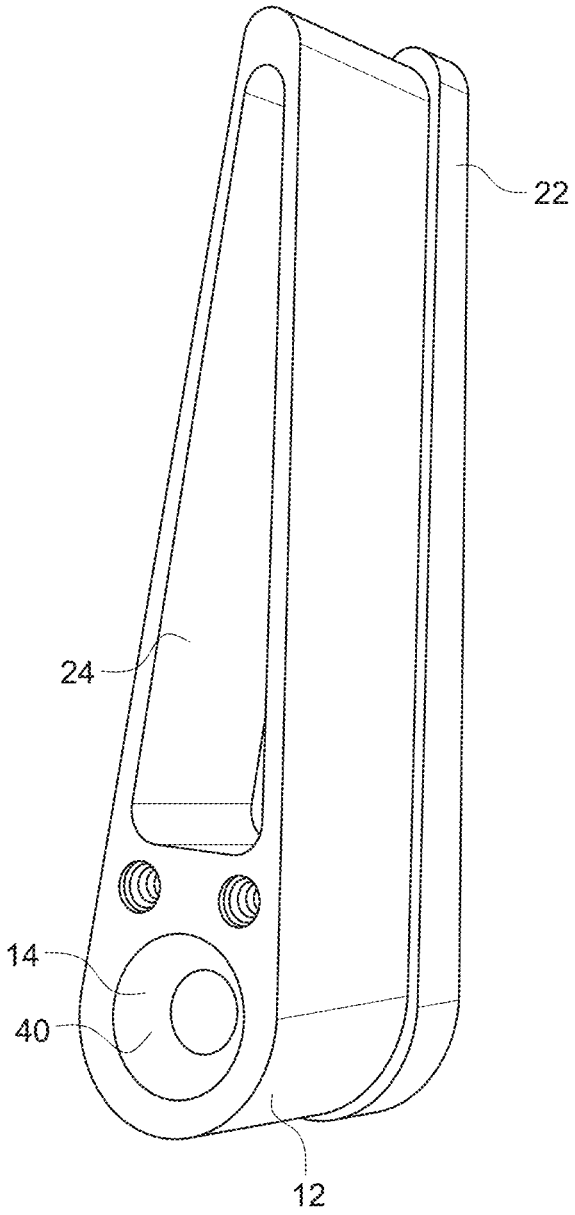
FIG. 11 depicts an overhead perspective view of a mode of the flipper of the system herein having a cavity which communicates through the body between openings at the top and bottom surfaces.
Figure 12:
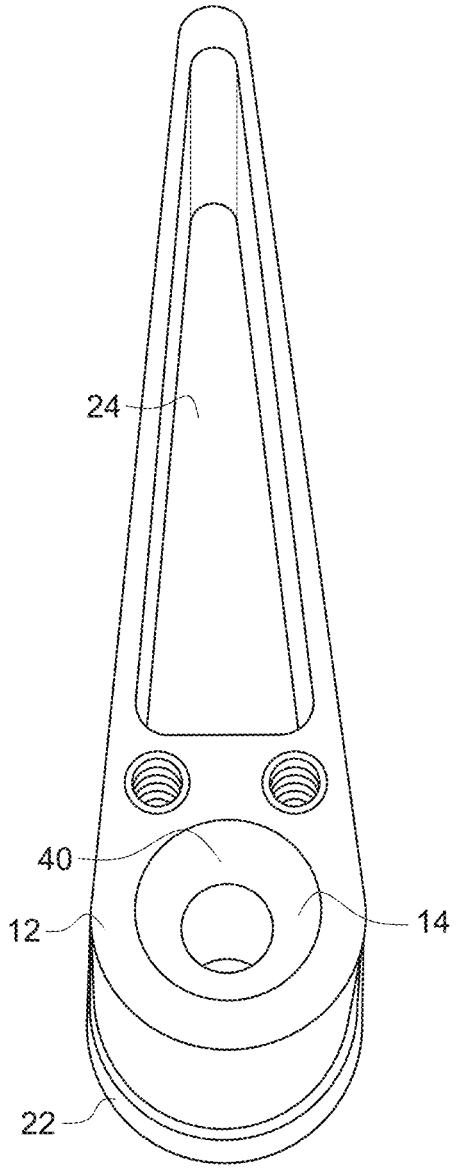
FIG. 12 shows another view of the flipper of FIG. 11.

FIG. 11 depicts an overhead perspective view of a mode of the flipper 12 of the system herein having a cavity 24 which communicates entirely through the body 16 between openings at the top and bottom surfaces. The body 16, as shown, has the same means for engagement at the first end thereof in the form of the opening 14 adapted for engagement to an actuator shaft 18. A second view of the device, as in FIG. 11, is shown in FIG. 12. The opening 14 such as shown in FIGS. 11-12 FIG. 3 can be configured with a tapered sidewall 40 which may be smooth or may include splines 31 (FIGS. 5 and 14) to engage with similar splines 31 on the engagement end 28 of the actuator shaft 18 shown herein. While the tapered configuration of both the opening 14 and engagement end 28 of the actuator shaft 18 is currently preferred, in order to self-center and self-level the engaged flipper 12 during an engagement, other cooperative engagements between the actuator shaft 18 and flipper 12 are anticipated and considered within the scope of this application.

Figure 15:
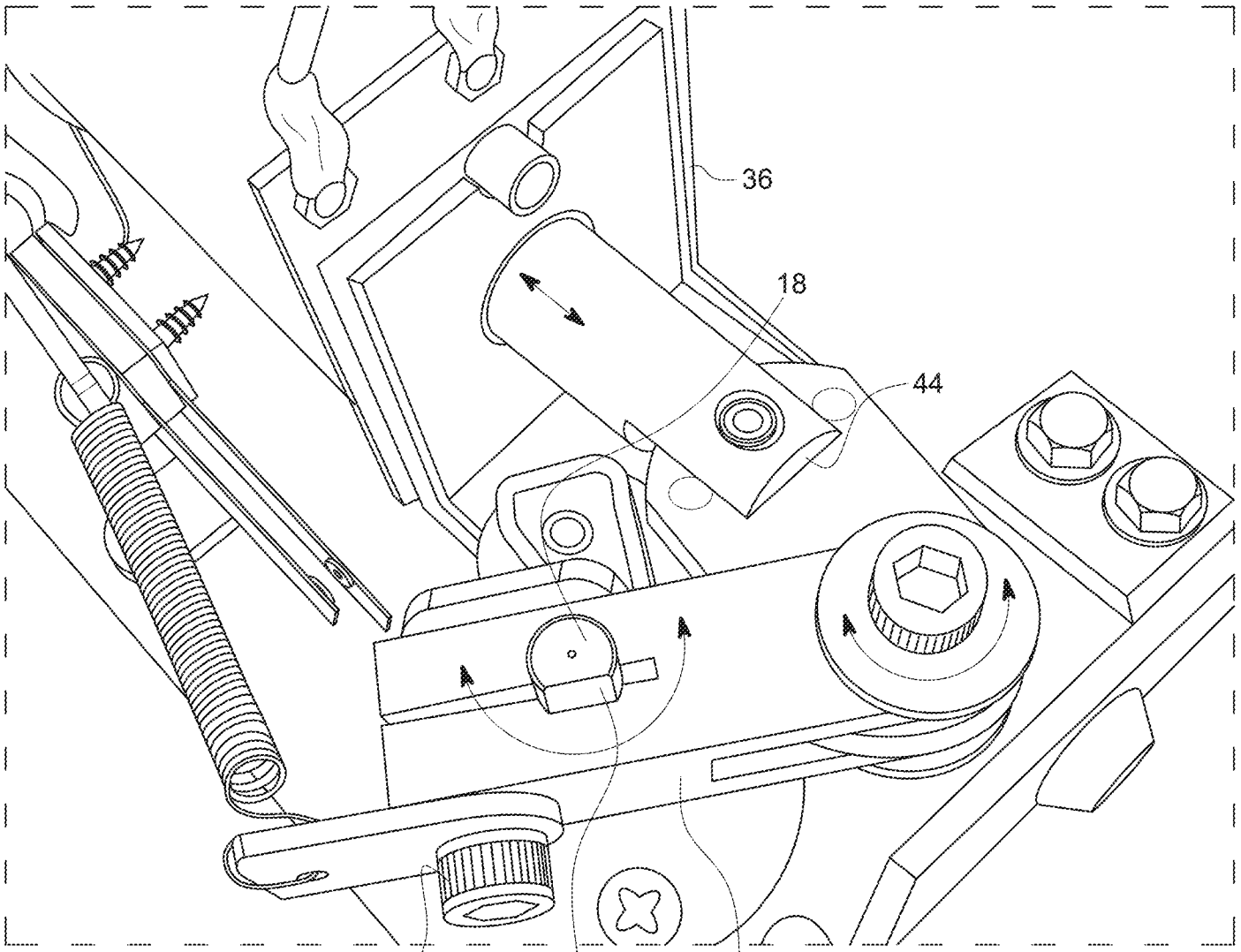
FIG. 15 depicts a conventional solenoid engaged to a clamp of the system herein and shows the shaft of FIG. 14 engaged with the provided clamp.

As noted, FIG. 13 shows a clamp 34 which may be included in the system 10 herein along with the actuator shaft 18 and flipper 12. The clamp 34, shown in FIG. 13 and in FIG. 15, is configured at a first end thereof to operatively connect with the translating plunger 44 of a conventional solenoid 36 widely used on conventional mechanical slot machines. The conventional clamp 34 has a shaft opening 38 which is round and engages a round actuator shaft 18. As noted, where the system 10 is provided to just use the conventional clamp, then the first end of the actuator shaft 18 will be round and in a diameter sized for a compressive engagement with the conventional clamp.

However, it has been found that a superior rotational engagement of the actuator shaft 18 with the plunger 44 of a solenoid 36 can be achieved by forming the first end of the actuator shaft 18 with a planar surface 46 thereon which mates to a planar side 18 of the shaft opening 38 as shown in FIG. 13. This engagement has shown in experimentation to be much more secure and totally resistant to slipping, which was found to sometimes occur where the flipper 12 herein is engaged using an actuator shaft 18 having a round first end. As such, in a mode of the system 10 herein which is resistant to slippage of the engagement of the actuator shaft 18 to the clamp 34, the system 10 provided the user would include the flipper 12, and an actuator shaft 18 as in FIG. 14 having the planar surface 48, along with a clamp 34 as in FIG. 13 which has a mating planar side 48 of the shaft opening 38 to contact against the planar surface 46.

This configuration is shown in FIG. 15 which shows the internal mechanism of conventional mechanical pinball machines as they have been employed for decades. As shown, the solenoid 36, once energized by the player pushing a flipper button or switch, will have a plunger 44 which will translate in one direction until the electric energy ceases wherein it will retract under the force of for example a spring. The plunger 44 is rotationally engaged to the shaft opening 38 on one end of the clamp 34 and will cause the clamp 34 to rotate along with the actuator shaft 18 which is engaged in a bearing or the like and communicates through the play surface of the pinball machine as shown best un FIG. 5 where the engagement end 28 projects above the play surface of the pinball machine 32. Also shown is the compressive engagement of an actuator shaft 18 which occurs in the conventional clamp 34 as well as the planar surface 48 clamp 34 herein.

As noted above, the planar surface 46 on the actuator shaft 18 of the system 10 herein is preferred where it is anticipated that the significant force of a metal flipper 12 impacting a metal pinball, might cause slippage. The compressive engagement of such clamps 34 is provided by a fastener such as a screw which will pull one side of the clamp 34 on an opposite side of a slot communicating with the shaft opening 38, inward to form the compressive engagement.

While all of the fundamental characteristics and features of the disclosed pinball arcade game flipper system herein have been shown and described herein, with reference to particular embodiments thereof, a latitude of modification, various changes and substitutions are intended in the foregoing disclosure and it will be apparent that in some instances, some features of the flipper system may be employed without a corresponding use of other features thereof, without departing from the scope of the invention as set forth. It should also be understood that various substitutions, modifications, and variations may be made by those skilled in the art upon their review of this specification, without departing from the spirit or scope of the flipper invention herein. Consequently, all such modifications and variations and substitutions are included within the scope of the invention as defined by the following claims.

What is claimed is:

1. A flipper system for a pinball game, comprising:

a flipper, said flipper having a body, said body having a first end extending to a second end;

said body having a top wall opposite a bottom side thereof;

an opening on said bottom side, said opening being adjacent said first end of said body;

an actuator shaft having a first end opposite an engagement end, said engagement end being rounded;

a fastener opening communicating through said top wall into said opening;

said first end of said actuator shaft positionable to an operative engagement with a solenoid of said pinball machine whereby a translation of said solenoid rotates said actuator shaft;

said opening removably engageable upon said engagement end of said actuator shaft without disengaging said operative engagement of said actuator shaft from said solenoid; and a fastener positionable through said fastener opening to a removable connection with said engagement end of said actuator shaft.

2. The flipper system for a pinball game of claim 1 additionally comprising:

a hollow cavity formed along an axis of said flipper body, said axis running in between said first end of said flipper body and said second end thereof.

3. The flipper system for a pinball game of claim 2 additionally comprising:

a ledge running around a perimeter edge of said body of said flipper; and a polymeric bumper removably engageable upon said ledge.

4. The flipper system for a pinball game of claim 3 additionally comprising:

said engagement end having a first taper; and said opening having a second taper complementary to said first taper wherein engagement of said opening upon said engagement end self-centers said opening thereon.

5. The flipper system for a pinball game of claim 2 additionally comprising:

said engagement end having a first taper; and said opening having a second taper complementary to said first taper wherein engagement of said opening upon said engagement end self-centers said opening thereon.

6. The flipper system for a pinball game of claim 2 wherein said operative engagement of said first end of said actuator shaft with a solenoid comprises:

a clamp having a shaft opening which is engageable to said actuator shaft at an engagement point in-between said first end thereof and said engagement end thereof; and an aperture engageable to a rotating connection at a distal end of a plunger of said solenoid.

7. The flipper system for a pinball game of claim 6 additionally comprising:

said shaft opening having a planar area therein;

said engagement point of said actuator shaft having a planar surface area; and said shaft opening compressible to contact said planar area against said planar surface area.

8. The flipper system for a pinball game of claim 1 additionally comprising:

a ledge running around a perimeter edge of said body of said flipper; and a polymeric bumper removably engageable upon said ledge.

9. The flipper system for a pinball game of claim 8 additionally comprising:

said engagement end having a first taper; and said opening having a second taper complementary to said first taper wherein engagement of said opening upon said engagement end self-centers said opening thereon.

10. The flipper system for a pinball game of claim 1 additionally comprising:

said engagement end having a first taper; and said opening having a second taper complementary to said first taper wherein engagement of said opening upon said engagement end self-centers said opening thereon.

11. The flipper system for a pinball game of claim 1 wherein said operative engagement of said first end of said actuator shaft with a solenoid comprises:

a clamp having a shaft opening which is engageable to said actuator shaft in between said first end thereof and said engagement end thereof; and an aperture engageable to a rotating connection at a distal end of a plunger of said solenoid.

12. The flipper system for a pinball game of claim 11 additionally comprising:

said shaft opening having a planar area therein;

said engagement point of said actuator shaft having a planar surface area; and said shaft opening compressible to contact said planar area against said planar surface area.

13. A flipper system for a pinball game, comprising:

a flipper, said flipper having a body, said body having a first end extending to a second end;

said body having a top wall opposite a bottom side thereof;

a rounded opening on said bottom side, said rounded opening located adjacent said first end of said body;

a fastener opening communicating through said body into said opening;

said rounded opening positionable upon a rounded engagement end of an actuator shaft extending through a playing surface of said pinball game from a first end of said actuator shaft connected with a solenoid, whereby said flipper is removably engageable to said actuator shaft without removing said solenoid; and a fastener positionable through said fastener opening to a removable connection against said engagement end of said actuator shaft.

14. The flipper system for a pinball game of claim 13 additionally comprising:

said rounded engagement end of said actuator shaft having a first taper; and said rounded opening having a second taper complementary to said first taper wherein an engagement of said rounded opening upon said rounded engagement end self-centers said opening thereon.

* * * * *